United States Patent [19]

Kennedy

[11] Patent Number: 4,643,330

[45] Date of Patent: Feb. 17, 1987

[54] CONTAINER SYSTEMS

[75] Inventor: Leo J. Kennedy, Toledo, Ohio

[73] Assignee: Owens-Illinois, Inc., Toledo, Ohio

[21] Appl. No.: 844,648

[22] Filed: Mar. 27, 1986

[51] Int. Cl.[4] ..... B65D 41/04

[52] U.S. Cl. ..... 220/288; 215/329; 220/296

[58] Field of Search ..... 220/288, 296, 302; 215/329, 217

[56] References Cited

U.S. PATENT DOCUMENTS 3,527,372 9/1970 Manning ..... 220/296

4,275,817 6/1981 Patton ..... 215/217

*Primary Examiner*—George T. Hall

*Attorney, Agent, or Firm*—John R. Nelson

[57] ABSTRACT

A method of making a package, and the resultant unique package, are disclosed. Spaced closure/container co-engaging means, such as interrupted thread segments, are disclosed which define open channels permitting rinsing and drainage of product, contaminants and moisture from the areas normally entrapping same between the closure and neck portion of the container. The invention also advantageously permits use of hermetic sealing structures in production processes not heretofore possible.

18 Claims, 12 Drawing Figures

CONTAINER SYSTEMS

BACKGROUND OF THE INVENTION

1. Field of the Invention

This invention relates generally to container systems and, more particularly, to container systems utilizing a container having a neck portion with an opening formed therein for dispensing the contents and a closure cooperating with the neck portion to retain the contents in the container and protect the contents from the ambient environment.

2. Description of the Prior Art

Screw caps or closures fall into two general categories. In the first class the caps have a continuous internal thread which cooperates with a corresponding external thread formed on the external surface of a neck portion or finish of a container. In the second class, caps have a plurality of spaced lugs or have interrupted threads, formed on the internal surface thereof, which cooperate with corresponding cams or interrupted thread segments formed on the external surface of the neck portion or finish of the container. The first class is by far the most common. Examples of the second class are found in U.S. Pat. Nos. 1,612,449 and 4,202,462.

In addition to the two general classes discussed above there are hybrids which use spaced interrupted threads on a closure in combination with continuous threads on a neck portion of a container, or vice versa. U.S. Pat. No. 1,783,314 discloses a closure with interrupted threads for use with a container having continuous threads on the neck portion.

While the invention disclosed herein is useful with the above-discussed container system, it is also useful with other closure/container combinations. For example, U.S. Pat. No. 3,968,823 discloses a container system utilizing a closure having a snap ring retention feature and a container having a neck portion with a detent groove formed therein for receiving the snap ring.

The U.S. Pat. No. 3,968,823 also discloses and discusses heat activatable sealing structures for hermetically sealing the openings of containers. Snap-on closures work well with such hermetic sealing approaches, if modified according to the present invention.

Lug caps, when used with containers with corresponding cam segments, are usually easier to apply and remove than continuous thread caps. One or more complete turns may be required to remove the continuous thread cap from a container, while a fraction of a turn will apply and remove most lug caps. Many lug caps are formed from metal, but metal has problems with corrosion and paint or laquer scratching on the surface. Moreover, such metal caps tend to be more expensive.

A typical unscrewing closure which is molded from synthetic plastic material consists of three main parts—a top wall, a skirt or side wall depending from the top wall and continuous threads formed on the interior wall of the skirt. The top wall, in combination with any desired additional sealing means such as a liner or gasket provides the necessary seal to protect the product in the container from the ambient environment. The threads provide the capability of applying force to hold the closure in its sealing position on the container. The skirt acts as a link between the threads and the top wall.

In many packaging applications the container systems currently available are unsatisfactory. In most container filling applications it is almost inevitable that some product will be spilled on and contaminate the outside of the finish or neck portion, and therefore also the inside threaded portion of a screw cap or closure. When a continuous thread closure is applied, product and/or moisture is trapped in the finish area inside the cap.

Even when no product is spilled on the finish, most filling operations are performed in high moisture areas, causing the trapping of moisture as discussed above. When it is desired to utilize a heat activatable sealing structure, this moisture becomes a contaminant because the moisture cannot escape, can be heated into a vapor stage, and otherwise interferes with the application of the hermetic seal to the container.

With the current prior art container systems, rinse water cannot successfully reach or be drained from the contaminated area. Product trapped in the area promotes growth of bacteria and is generally unsightly. This cannot be tolerated in a food package.

SUMMARY OF THE INVENTION

Although a number of the prior art patents discussed above disclose interrupted thread segments, lug or inclined cam thread segments, snap-on closure retention means, and the like for different purposes, there is no disclosure of using thread means of the above or other types to define open channels for rinsing and/or draining fluids from neck portions of containers when the closure is in place on the neck.

Therefore, an improved package is disclosed which includes a container having a neck portion with an opening formed therein for dispensing the contents. A closure for the container includes top wall means having a contour which covers the neck portion opening.

First means are formed on the neck portion and second means are formed on the closure which are adapted to mutually cooperate at a spaced plurality of sites to maintain the closure in a closing relationship with respect to the opening in the neck portion. At least one of the first and second means defines a plurality of open channels around the neck portion between the cooperation sites. Therefore, introduction of rinse water to contaminated areas and escape of rinse water is possible. Moreover, contaminant in the form of water, moisture, or vapor, which might interfere with the application of a hermetic seal or cause a liner or other seal system to deteriorate, can escape through the open channels.

The above-noted first and second means preferably have substantially coextensive contact at each cooperation site to prevent any significant retention of contaminants between the two means. Hermetic sealing means for the opening including heat responsive or heat activatable adhering mean is advantageously used in the package of this invention.

The package advantageously uses container and closure components formed from synthetic plastic materials to reduce the cost and to provide more design freedom in the shape of the package. However, the teachings herein are applicable to containers and closures made of other materials, such as glass and metal for containers and metal for closures.

The first and second cooperating or engaging means advantageously comprise spaced thread means, particularly when the components are formed from synthetic plastic materials. For quick assembly of the closure to the neck portion the length of each thread means is less than the space between thread means, thereby enabling the closure to be dropped onto the neck and tightened into place with a fraction of a turn.

The thread means advantageously comprises interrupted thread segments which follow the same helix angle, particularly with plastic components since such cooperating thread segments have more closure retention gripping capacity. In some plastic and other materials applications the thread means may be spaced inclined cam segments.

In still other applications the first and second cooperating means may be snap-on or other closure retention means, e.g. a female detent on one of the neck portions or closure means, and male stop means on the other.

There is also disclosed a method for manufacturing a package which includes the steps of forming a container with a neck portion having an opening therein for dispensing the contents, and forming a closure which includes top wall means having a contour which covers the neck portion opening.

Means are formed on the neck portion and the closure to engage and cooperate with each other at a spaced plurality of sites to maintain the closure on the neck portion. The neck portion and closure engaging means are formed to define a plurality of open channels between the plurality of cooperation sites to enable fluid drainage from the neck portion and closure means after the closure means is assembled on the neck portion.

It is an object of this invention to provide an improved package which permits removal of contaminants from an assembled neck portion/closure area.

It is a further object of this invention to provide a unique package which enables the most productive use of heat responsive or heat activatable hermetic sealing structures.

It is a still further object of this invention to provide a unique package that can be made from synthetic plastic materials and still be effectively used in wide-mouth container applications.

Other objects, advantages and features of the invention will become apparent when the following description is taken in conjunction with the accompanying drawings.

BRIEF DESCRIPTION OF THE DRAWINGS

In the drawings, where like numerals are employed to designate like parts throughout.

DESCRIPTION OF THE PREFERRED EMBODIMENTS

Figure 1:
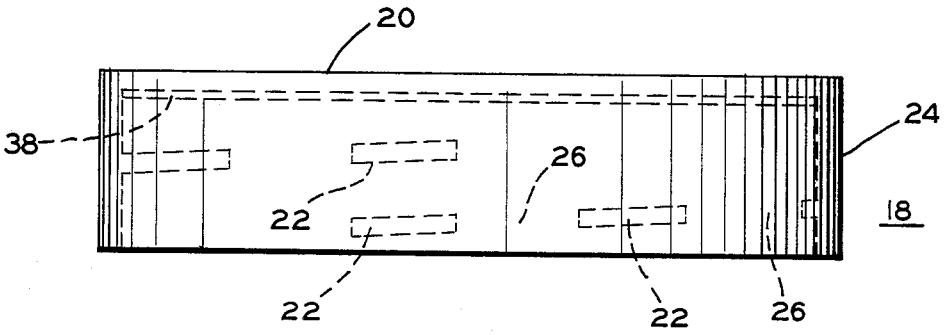
FIG. 1 is a side elevational view of a closure embodying the teachings of this invention.
Figure 2:
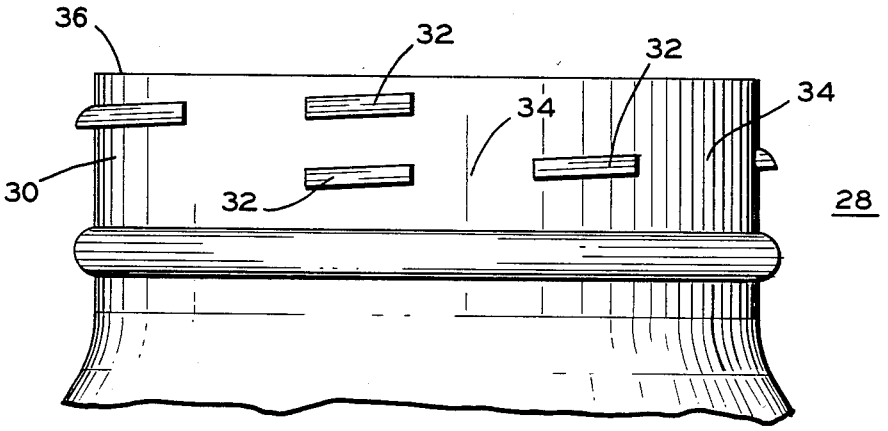
FIG. 2 is a side elevational view of the neck portion or finish of a container embodying the teachings of this invention, which may be used with the closure illustrated in FIG. 1.

Referring now to FIGS. 1 and 2 there is illustrated a closure means generally indicated at 18 in FIG. 1 and a container generally indicated at 28 in FIG. 2 which embody the teachings of the package of this invention.

The closure 18 includes a top wall means 20 and interrupted thread segments 22, only the thread segments on the front inside of the closure 18 being shown in dashed lines for purposes of clarity. A cylindrical skirt or side wall 24 is shown as a means depending from the top wall 20 for supporting or carrying the segments 22 in a position to engage and cooperate with complementary segments 32 on the neck portion 30 of the container 28 shown in FIG. 2, to retain the top wall 20 in a closing relationship on the container.

Although the top wall means 20 is shown as a one piece disk, it is to be understood that the disclosure is intended to cover other top wall structures. For example, particularly in wide mouth containers, it is sometimes preferred to have a separate disk with sealing means thereon for contact with the finish. Sealing pressure is applied to the sealing disk by an annular ring overlying the disk and having a skirt or other means depending therefrom to carry or support thread means.

The container 28 includes the neck portion 30 and interrupted thread segments 32 formed on the cylindrical outer surface of the neck portion. The upper edge 36 defines an opening in the neck portion 30 for dispensing the contents of the container.

The thread segments 22, 32, are spaced around the cylindrical interior surface of skirt 24 and the cylindrical exterior surface of the neck portion 30, respectively.

In this embodiment, it is preferred that the thread segments 22 of closure 18 be spaced farther apart than the width of the thread segments 22. This allows the separation of the closure from the mold part carrying the female thread die by turning the mold part or the closure only a short fraction of a turn, and sliding the thread segments vertically through the gap between the thread segments. In many designs using the teachings of this invention, even a fraction of a turn will not be necessary, since the spaced thread segments can be easily stripped from the mold.

If an unscrewing motion is required to remove a particular design from the mold, this invention permits closure ejection with less than an inch unscrewing stroke, compared to a 13 to 15 inch unscrewing stroke on a comparable closure with conventional continuous threads. Such a short stroke can be provided by mold opening mechanisms, thereby eliminating hydraulic cylinders, cam rails, and cam followers.

The number and spacing of thread segments 22, 32 will be in part governed by the size of the closure and the torque requirements of a particular application. The thread means 22, 32 are interrupted thread segments which follow a predetermined helix angle.

An additional sealing means 38 may be carried beneath the top wall 20 within closure 18 as shown in FIG. 1. This additional sealing between the top wall 20 and the upper edge 36 of the neck portion 30 may be provided by liners, gaskets, heat-activated or heat-responsive adhering structures, or other known sealing means.

The interrupted thread segments 22 cooperate with and engage the interrupted thread segments 32 to retain the closure 18 in a sealing relationship on neck portion 30. The finish thread segments 32 are preferably separated by gaps, spaces or distances 34 which are greater than the arcuate lengths of the closure thread segments 22. The closure 18 may then be applied to such a finish by guiding the closure thread segments 22 down through the gaps or spaces 34 between the neck portion thread segments until the top wall 20 makes initial contact with the upper edge 36 of neck portion 30. Then a fraction of a turn of the closure 18 would complete the sealing relationship of the closure.

Conversely, the spaces or gaps 26 between thread segments 22 must be greater than the arcuate lengths of thread segments 32 on neck portion 30 to allow segments 32 to move between segments 22 of the closure 18.

A closure and neck portion of the present invention does not have the limitation on the number of thread segments that presents a practical limitation when molding the continuous thread closure of the prior art. Therefore, more thread segments can be provided in each vertical thread segment forming area, e.g. see the stacked relationship of thread segments 22 in FIG. 1 and segments 32 in FIG. 2. More than two segments can be provided in the stacked relationship in the vertical segment forming area if desired to meet the torque or retention requirements for a particular application. Thus, this invention would speed and simplify cap application in a production process, because only a fraction of a turn is necessary to assemble without losing the torque and sealing force advantages of a continuous thread closure.

The thread segments 22, 32 are preferably formed to have substantially the same arcuate lengths, so that when assembled their mutual engaging surfaces have coextensive contact throughout their lengths to prevent any significant retention of product that may have been spilled on the finish during a filling process. Moreover, proper design of the segments enables a mutual wiping and squeezing action which pushes any product or other contaminant product on the segments to the ends thereof during the assembly of the cap or closure onto to neck portion, where it can be washed or rinsed away as will be described below.

One of the more important features of this invention involves the concept of forming a plurality of open channels between cooperating sets of thread means or other means for retaining the closure on the container. In the embodiment illustrated in FIGS. 1 and 2, this is accomplished by forming the closure and neck portion thread segments so that they cooperate at a spaced plurality of sites, thereby defining a plurality of open channels around the neck portion between the cooperation sites. This occurs with the alignment of spaces or gaps 26, 34 of the closure 18 and neck portion 30, respectively.

When product is spilled on the finish during a filling operation, or other contaminant gets on the finish, rinse water or other fluid can be directed into the open channels after the closure is applied and the container opening is sealed. The entrapped product or other contaminant is washed out by this process. The open channels then also permit drainage and drying of the neck portion and interior walls of the closure, providing a dry and sanitary container finish for the consumer.

Experiments were conducted to test the invention in comparison to current commercial packages. The packages tested were grouped as follows:

(1) A package with open channels according to the teachings of this invention. The closure liner was a single disk of foam styrene.

(2) A package like that of group (1), except that a foam styrene backed heat responsive seal liner was used.

(3) A package with continuous threads on both the closure and the finish. A single disk of foam styrene was used as a liner.

(4) A package with continuous threads on both the closure and the finish. A foam styrene backed heat responsive seal liner was used.

(5) A package with continuous threads on both the closure and the finish, a pulpboard backed heat responsive seal liner was used.

The entire finish areas of all of the containers were dipped in a mixed vegetable juice to make sure that all were equally exposed to the product. Each container was then hot filled (180 degrees F), sealed and placed in a cold water shower to simulate a water spray cooling tunnel.

After a drying period, the containers were checked. Groups (1) and (2) were completely clean and dry. Groups (3) and (4) had dried residual product on the finish and inside of the closure. Group (3) also had moisture trapped between the top wall of the closure and the foam styrene disk indicating siphoning. Group (5) had residual product on the finish and inside of the closure and the pulpboard backing of the liner was wet, indicating siphoning back under the cap.

The tests also proved another important feature of the invention. It is desirable to form both the container and the closure from synthetic plastic materials to take advantage of reduced costs and increased design freedom. In the past it has not been possible to be consistently successful in using pre-lined plastic closures on a plastic bottle in a production line, where the liner was to be hermetically sealed to the bottle finish by a heat responsive or heat activation adhering process. The product or incidental ambient moisture in a filling line area was trapped in the enclosed neck portion/closure area by the continuous threads on both the neck portion and closure. Without the open channels of the present invention such moisture or product, or vapors formed therefrom in response to the heating, prevented consistent heat sealing.

While heat-responsive and heat-activatable hermetic sealing structures themselves are not part of this invention, the combination of such a hermetic sealing structure, a part of the unique package is part of this invention. Suitable hermetic sealing structures are known in the art. In U.S. Pat. No. 3,968,823 heat causes a polyethylene film to fuse to the container. In U.S. Pat. No.

4,013,188 a heat activated paraffin-based resin is the adhering means. Those disclosures are incorporated herein by reference thereto.

Another important feature of this invention relates to the problems currently encountered in using twist-off lug type threads in a closure. A metal cap which is ring-lined with a plastic sealing material is applied with a short twisting action onto a container finish with an intermittent lug thread profile spaced around the finish. Each one of the finish lugs are on the same horizontal plane with respect to each other and are all made with the same helix angle, so that when the metal lug cap is applied each of the metal closure lugs achieves an undercut point contact with a matching finish lug.

It is possible that the metal lug cap could back off were it not for the internal vacuum inside the container. This is one reason why ordinary "lug" caps have not been too successful with plastic containers. The plastic container ordinarily will not maintain any significant internal vacuum. Also, adequate undercut retention of the metal lug cap is difficult to maintain on a flexible plastic lug finish, especially in a hot fill application where the plastic container thread is significantly softened by temperature.

Therefore, while the teachings of this invention are applicable to other materials, they are particularly advantageous when using synthetic plastic materials for the container and the closure. The ability to stack the number of thread means necessary in each vertical area between the open channels enables the design of retention forces or gripping forces between synthetic plastic thread means on both the container finish and the closure to prevent any backing off of the closure—whether significant internal vacuums are present or not and/or whether or not used in a hot fill application.

Figure 3:
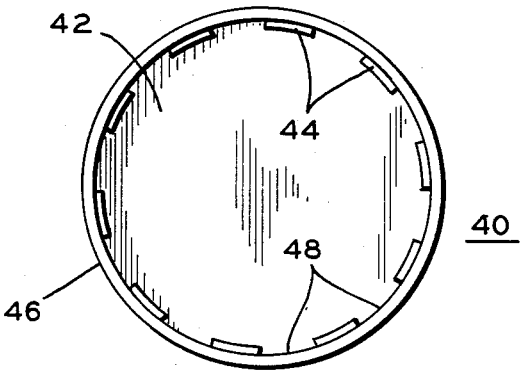
FIG. 3 is a bottom view of a closure embodying the teachings of this invention.
Figure 4:
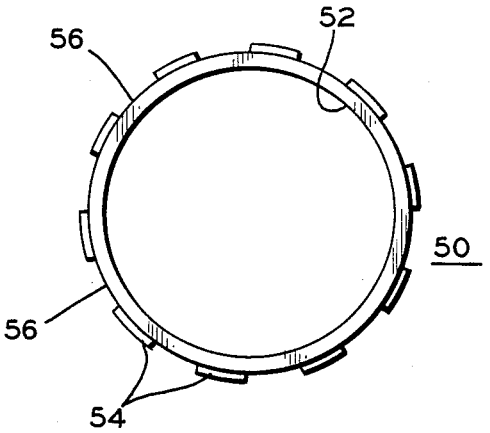
FIG. 4 is a plan view of a finish or neck portion embodying the teachings of this invention, which may be used with the closure illustrated in FIG. 3.

Referring now to FIGS. 3 and 4 a bottom view of a closure and an plan view of a container finish, respectively, are shown to give further clarifying views of the teachings of this invention.

In FIG. 3 a closure indicated generally at 40 has top wall means 42, spaced thread means 44, and side wall means 46 depending from the top wall to carry the thread means 44.

In FIG. 4 a neck portion or finish is indicated generally at 50. A top edge 52 of the finish defines an opening for dispensing the contents. A plurality of thread means 54 are cylindrically spaced around the external surface 56 of the neck portion 50.

Figure 5:
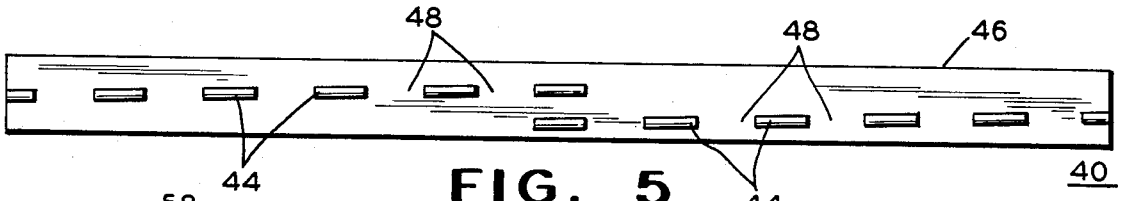
FIG. 5 is an elevational view of the skirt or side wall of a closure, which has been laid out flat to more clearly illustrate the disposition of the interrupted thread segments thereon.
Figure 6:
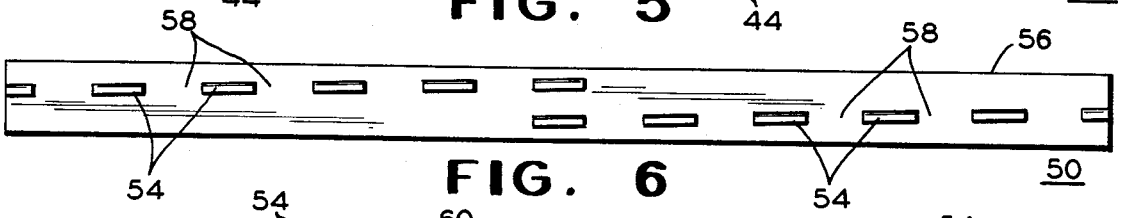
FIG. 6 is an elevational view of a finish or neck portion designed to be used with the closure of FIG. 5, which has been laid out flat to more clearly illustrate the disposition of the interrupted thread segments thereon.
Figure 7:
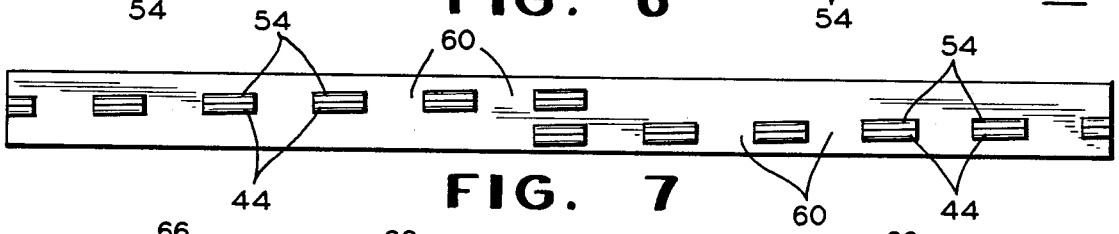
FIG. 7 is an elevational diagrammatic view laid out flat showing the relative positions of the interrupted thread segments of the closure illustrated in FIG. 5 and the thread segments of the finish illustrated in FIG. 6, after the closure has been screwed on or assembled with the finish.

Referring now to FIGS. 5, 6 and 7 there is illustrated diagrammatically thread configurations for a closure such as shown in FIG. 3, a neck portion or finish as shown in FIG. 4, and the relative thread set juxtapositions when the closure is applied to the finish, respectively.

In FIG. 5 the closure thread means are shown as interrupted thread segments 44 positioned on the internal surface of side wall 46 with spaces or gaps 48 in between. The thread segments 44 are all laid out on the same helix angle.

In FIG. 6 the finish thread means are shown as interrupted thread segments 54 on the external surface 56 of the finish with spaces or gaps 58 in between. The thread segments 54 follow the same helix angle as segments 44 on the closure.

In FIG. 7, the closure segments 44 are shown in their juxtaposition with finish segments 54 when the closure is fully torqued on the finish to bring the top wall means with a closing and/or sealing relationship with the finish. In this position, the segments 44, 54 have coextensive contact throughout their length, and the gaps or spaces 48, 58 are aligned to define open channels 60.

Figure 8:
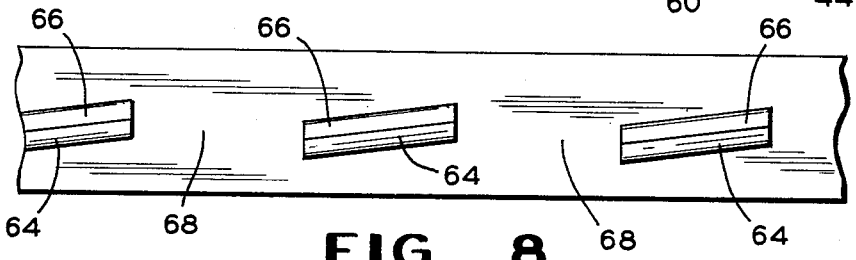
FIG. 8 is an elevational diagrammatic view laid out flat of a further embodiment of this invention showing the relative positions of inclined cam thread segments of a closure and a finish after the closure and finish are in their assembled position.

Referring now to FIG. 8, there is shown diagrammatically thread means comprising inclined cam segments in their juxtaposed positions. In this embodiment, closure inclined cam segments 64 are designed to align with finish inclined cam segments 66 to define open channels 68 between the juxtaposed sets of closure and finish segments.

Referring now to FIGS. 9 through 12 there is illustrated an embodiment of the teachings of this invention noting the application of the principles thereof to neck portions of containers not having cylindrical surfaces and openings, and to means for mutually engaging the closure to the neck portion without the use of thread means.

It is desirable to be able to provide containers with neck portions in a variety of design shapes to accomplish particular objectives, e.g. pouring spouts for the contents or to provide a particular molded shape of a food product to be dispensed as a single body for serving. Therefore, while the closure and neck portion shown in the embodiment of FIGS. 9 through 12 represents square and rectangular versions, it is intended to be representative of any design shape that is desired which has an opening (or openings) contour other than circular.

Figure 9:
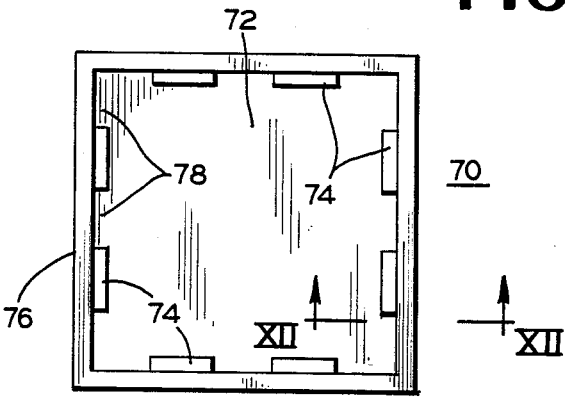
FIG. 9 is a bottom view of a still further embodiment of a closure illustrating the teachings of this invention.

In FIG. 9 in a bottom view a closure is indicated generally at 70 includes top wall means 72, spaced stop means 74 for cooperating with and engaging detent means on a neck portion, and side wall means 76 depending from the top wall means for carrying or supporting the stop means 74. Spaces or gaps 78 separate the stop means 78.

Figure 10:
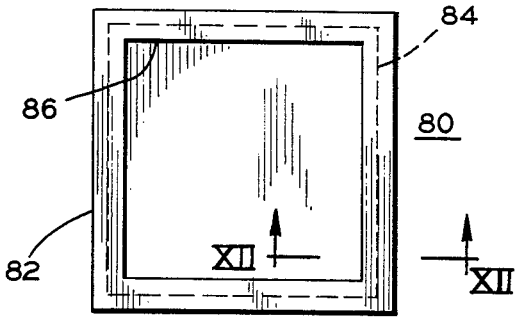
FIG. 10 is a plan view of a finish designed to cooperate with the closure of FIG. 9.

In FIG. 10 in a plan view a container is indicated generally at 80 and includes a neck portion 82 having a V-shaped groove detent 84 formed in the neck portion 82 around the external surface thereof below the top edge 86, which defines the opening in the neck portion.

Figure 11:
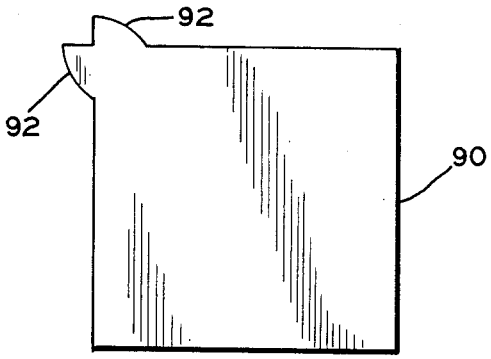
FIG. 11 is a plan view of a hermetic sealing structure which may be used with the apparatus illustrated in FIGS. 9 and 10.

A hermetic sealing structure 90 is shown in plan view in FIG. 11, and is designed to fit against the top wall 72 of the closure 70. Pull tab means 92 eases the removal of the sealing structure from the opening of the container.

Figure 12:
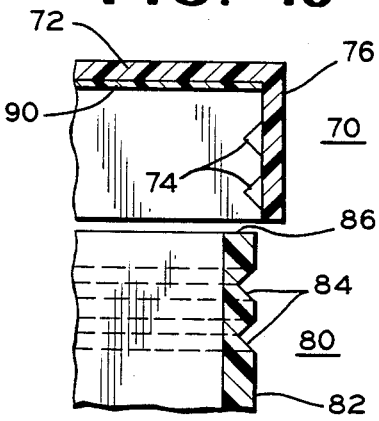
FIG. 12 is a view in section taken along lines XII—XII in FIGS. 9 and 10, showing the closure and finish ready to be assembled.

Referring now to FIG. 12 there is shown sectional views of the closure 70 and container 80 taken along lines XII—XII, positioned as they would appear just before the closure is applied to the container. As can be seen, one or more V-shaped stop means 74 in a stacked relationship on the side wall 76 are adapted to engage corresponding detent grooves 84 formed on the neck portion. The position of the engaging means can be reversed. That is, the stop means may be formed on the neck portion and the detent means may be formed in the interior surface of the side wall of the closure.

Such a closure is preferably formed from a synthetic plastic or other material which enables deformation of the closure side walls outwardly to permit the stop means to slide over and down the neck portion to engage the detent grooves. The spring action of such side wall material then urges the stop means into the detent grooves. Since the upper edges of both the groove and the stop means is angled, the spring action urging the stop means inwardly also tends to pull the closure downwardly so that the liner or hermetic sealing structure 90 is urged against the top edge 86 of the neck portion.

The spaces or gaps 78 thus define open channels between the neck portion/closure engaging means to perform the functions disclosed hereinbefore. In this particular embodiment the open channels also are advantageous in permitting use of a hermetic sealing structure without interference from entrapped moisture.

There has thus been disclosed a unique package, and method for making same, which is less expensive from both a materials and production standpoint and which provides additional design freedom.

The form of the invention herein shown and described is to be taken as illustrative only, and changes in the shape, size and arrangement of the parts, or in the steps of the method, may be made without departing from the spirit and scope of the invention.

I claim:

1. A package, comprising;

(a) a container having a neck portion with an opening formed therein for dispensing the contents, (b) closure means including top wall means having a contour which covers said neck portion opening, and (c) first means formed on said neck portion and second means formed on said closure means adapted to mutually cooperate at a spaced plurality of sites to maintain said closure top wall means in closing relationship over said neck portion opening, at least one of said first and second means defining a plurality of open channels around said neck portion between cooperation sites thereby enabling fluid drainage from said neck portion.

2. A package according to claim 1 in which said first and second means have substantially coextensive contact at each cooperation site, thereby preventing any significant retention of contaminants between said first and second means.

3. A package according to claim 1 which further includes means for sealing the opening in said neck portion comprising means responsive to heat for adhering said sealing means to said neck portion around the opening formed therein.

4. A package according to claim 3 in which said sealing means includes electrically conductive material disposed in heating relationship with said heat responsive means and adapted to provide adhering heat in response to application of induction current generation therein.

5. A package according to claim 1 in which said first and second cooperating means each comprises spaced thread means.

6. A package according to claim 5 in which the length of said thread means on one of said neck portion and closure means is less than the space between said thread means, on the other of said neck portion and closure means thereby enabling said top wall means to first be brought into contact with said neck portion and tightened in place with a fraction of a turn.

7. A package according to claim 5 in which said thread means comprises interrupted thread segments following the same helix angle.

8. A package according to claim 5 in which said thread means comprises spaced inclined cam segments.

9. A package according to claim 1 in which said first and second cooperating means comprises female detent means on one of said neck portion and closure means for receiving male stop means on the other of said neck portion and closure means.

10. A package as defined in claim 1 in which said container and closure means are formed from snythetic plastic material.

11. A package, comprising;

(a) a container having a neck portion with a cylindrical external surface and with an opening formed therein for dispensing the contents, (b) a plurality of container thread means formed on and spaced around said external surface of said neck portion, and (c) a closure for said container including top wall means, a plurality of cylindrically spaced thread means, and means depending from said top wall means for supporting said closure thread means in engaging relationship with said container thread means enabling cooperation therebetween to bring and retain said top wall means into closing relationship with said opening in said neck portion, (d) said engaged container and closure thread means being substantially coextensive in length when said top wall means is retained in said closing relationship, thereby defining open channels between engaged thread means sets substantially to prevent retention of contaminants and to permit fluid drainage from adjacent neck portion and closure means surfaces.

12. A package as defined in claim 11 which further includes means for hermetically sealing said opening comprising heat activatable adhering means, any gaseous or liquid fluids released as result of activating said adhering means being directed to the ambient atmosphere via said defined open channels.

13. A package as defined in claim 12 in which said container and closure means are formed from synthetic plastic material, the combination recited permitting the direction of hot rinsing fluids into said open channels to remove product that may have spilled during a filling process from said neck portion and closure surfaces without breaching the hermetic seal.

14. A package as defined in claim 11 in which said container and closure thread means comprise matching interrupted thread segments following a predetermined helix angle.

15. A method of manufacturing a package comprising the steps of:

(a) forming a container with a neck portion having an opening therein for dispensing a product, (b) forming means on said neck portion to engage a closure means, (c) forming a closure means for said container which includes top wall means having a contour which covers said neck portion opening, (d) forming means on said closure means adapted to engage and cooperate with said engaging means on said neck portion at a spaced plurality of sites to maintain said closure top wall means in closing relationship over said neck portion opening, (e) said neck portion and closure engaging means being formed to define a plurality of open channels between said plurality of cooperation sites thereby enabling fluid drainage from said neck portion and closure means after the closure means is assembled therewith.

16. A method as defined in claim 15 which further includes the step of forming said neck portion and closure engaging means so that they have substantially coextensive contact with each other at each cooperation site to prevent any significant retention of contaminants therebetween in their assembled position.

17. A method as defined in claim 15 which further includes the step of providing a heat activated sealing structure interposed between said top wall means and said neck portion to cover said opening, said open channels providing drainage for gaseous or liquid fluids that may interfere with the sealing process.

18. A method as defined in claim 15 which further includes forming means depending from said top wall means to carry said closure engaging means.

* * * * *